US011137170B2

(12) United States Patent
Shi

(10) Patent No.: US 11,137,170 B2
(45) Date of Patent: Oct. 5, 2021

(54) HEAT PUMP SYSTEM AND START UP CONTROL METHOD THEREOF

(71) Applicant: Carrier Corporation, Palm Beach Gardens, FL (US)

(72) Inventor: Runfu Shi, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 41 days.

(21) Appl. No.: 16/349,001

(22) PCT Filed: Nov. 7, 2017

(86) PCT No.: PCT/US2017/060318

§ 371 (c)(1),
(2) Date: May 10, 2019

(87) PCT Pub. No.: WO2018/089336

PCT Pub. Date: May 17, 2018

(65) Prior Publication Data

US 2019/0285317 A1 Sep. 19, 2019

(30) Foreign Application Priority Data

Nov. 11, 2016 (CN) ..... 201610993121.X

(51) Int. Cl.
*F25B 1/10* (2006.01)
*F25B 41/39* (2021.01)

(52) U.S. Cl.
CPC ..... *F25B 1/10* (2013.01); *F25B 41/39* (2021.01); *F25B 2341/06* (2013.01);
(Continued)

(58) Field of Classification Search
CPC ..... F25B 2600/2509; F25B 2500/26; F25B 1/10; F25B 2400/13
See application file for complete search history.

(56) References Cited

U.S. PATENT DOCUMENTS 4,267,704 A 5/1981 Yapp
4,270,361 A 6/1981 La Barge
(Continued)

FOREIGN PATENT DOCUMENTS

CN 1982798 A 6/2007
EP 1041286 A2 10/2000
(Continued)

OTHER PUBLICATIONS

International Search Report and Written Opinion for application PCT/US2017/060318, dated Jan. 19, 2018, 13 pages.
(Continued)

*Primary Examiner* — Marc E Norman
*Assistant Examiner* — Schyler S Sanks
(74) *Attorney, Agent, or Firm* — Cantor Colburn LLP

(57) ABSTRACT

A heat pump system comprises: a main heat exchange circuit, comprising a two-stage compressor (100*a*,100*b*), a condenser (200), a throttle element (300*a*,300*b*) and an evaporator (400), which are connected in sequence to form a circuit; an economizer, disposed between the condenser and the evaporator; a gas supplement branch, connecting a gas outlet of the economizer to a gas supplement port of the compressor, with an economizer regulating valve (600) for controlling the opening and closing of a flow path being arranged on the gas supplement branch; and a control device, wherein the control device controls the opening and closing of the economizer regulating valve based on a refrigerant state feature in the evaporator during a start-up stage of the heat pump system.

12 Claims, 3 Drawing Sheets

(52) U.S. Cl.
CPC ..... *F25B 2400/13* (2013.01); *F25B 2500/26* (2013.01); *F25B 2600/2509* (2013.01)

(56) References Cited

U.S. PATENT DOCUMENTS

| | | | |
|---|---|---|---|
| 4,506,516 | A | 3/1985 | Lord |
| 5,303,562 | A | 4/1994 | Babel et al. |
| 5,537,830 | A | 7/1996 | Goshaw et al. |
| 6,035,651 | A | 3/2000 | Carey |
| 6,176,092 | B1 | 1/2001 | Butterworth et al. |
| 6,202,431 | B1 | 3/2001 | Beaverson et al. |
| 6,886,354 | B2 | 5/2005 | Dudley |
| 6,983,617 | B2 | 1/2006 | Halwan et al. |
| 7,890,215 | B2 | 2/2011 | Duncan |
| 8,151,583 | B2 | 4/2012 | Douglas |
| 8,567,206 | B2 | 10/2013 | Eisenhour |
| 8,973,379 | B2 | 3/2015 | Bittner et al. |
| 9,194,393 | B2 | 11/2015 | Pham |
| 2006/0218959 | A1 | 10/2006 | Sandkoetter |
| 2010/0115974 | A1 | 5/2010 | Okaza et al. |
| 2010/0281894 | A1 | 11/2010 | Huff |
| 2011/0113797 | A1 | 5/2011 | Peyaud et al. |
| 2012/0318008 | A1* | 12/2012 | Liu ..... B60H 1/3228 62/115 |
| 2014/0260385 | A1* | 9/2014 | Umeda ..... F25B 49/022 62/180 |
| 2014/0360210 | A1 | 12/2014 | Lapp et al. |

FOREIGN PATENT DOCUMENTS

| | | | |
|---|---|---|---|
| EP | 1953388 | A1 | 8/2008 |
| EP | 1957894 | B1 | 8/2010 |
| JP | H0237259 | A | 2/1990 |
| JP | 3164626 | B2 | 5/2001 |
| WO | 0194859 | A1 | 12/2001 |

OTHER PUBLICATIONS

Chinese Office Action for Application No. 201610993121.X; dated Oct. 23, 2020; 8 Pages.

* cited by examiner

HEAT PUMP SYSTEM AND START UP CONTROL METHOD THEREOF

TECHNICAL FIELD

The present invention relates to the field of heat pump systems and, more particularly, to a start-up control method for a heat pump system.

BACKGROUND ART

In the current refrigeration system using a gas supplement and enthalpy increasing compressor, an economizer is usually used to supplement gas for an intermediate stage of the compressor. Such gas supplement branch generally comprises a throttle element for throttling the refrigerant here, a circuit for exchanging heat with the economizer, and an economizer regulating valve for controlling the branch. The economizer regulating valve is usually a normally closed valve, and has a delayed start with the power-on of the entire unit, so as to maintain the normal operation of the entire system. However, when the unit is initially set, the duration of the delay period of the delayed start is difficult to determine, because the operating conditions of the unit depends on the unit installation environment to a certain extent. In some cases, if the delay period is long, the economizer regulating valve has not been opened during this period, which will cause the refrigerant in the evaporator to be continuously pumped into the compressor, resulting in the problem of too low evaporation pressure. On the other hand, if the delay period is short, relative more refrigerant liquid is still accumulated in the economizer, which will cause excessive refrigerant liquid to be pumped into the intermediate stage of the compressor, resulting in surge and other problems and affecting the reliability and safety of the unit.

SUMMARY OF THE INVENTION

An object of the present invention is to provide a heat pump system capable of being stably started up.

A object of the present invention is further to provide a start-up control method for stably starting a heat pump system.

In order to achieve the objects of the present invention, according to one aspect of the present invention, there is provided a heat pump system, comprising: a main heat exchange circuit, comprising a two-stage compressor, a condenser, a throttle element and an evaporator, which are connected in sequence to form a circuit; an economizer, disposed between the condenser and the evaporator; a gas supplement branch, connecting a gas outlet of the economizer to a gas supplement port of the compressor, with an economizer regulating valve for controlling the opening and closing of a flow path being arranged on the gas supplement branch; and a control device, wherein the control device controls the opening and closing of the economizer regulating valve based on a refrigerant state feature in the evaporator during a start-up stage of the heat pump system.

According to a further aspect of the present invention, there is also provided a start-up control method for a heat pump system, comprising: S100, during a first preset period after the compressor is started, if the refrigerant state feature in the evaporator is lower than a set threshold, the economizer regulating valve is opened and then the refrigerant accumulated in the economizer is pumped into the compressor; and/or S200, during the first preset period after the compressor is started, if the refrigerant state feature in the evaporator is higher than the set threshold, the economizer regulating valve is opened after the first preset period and then the refrigerant accumulated in the economizer is pumped into the compressor.

DETAILED DESCRIPTION OF EMBODIMENTS

Figure 1:
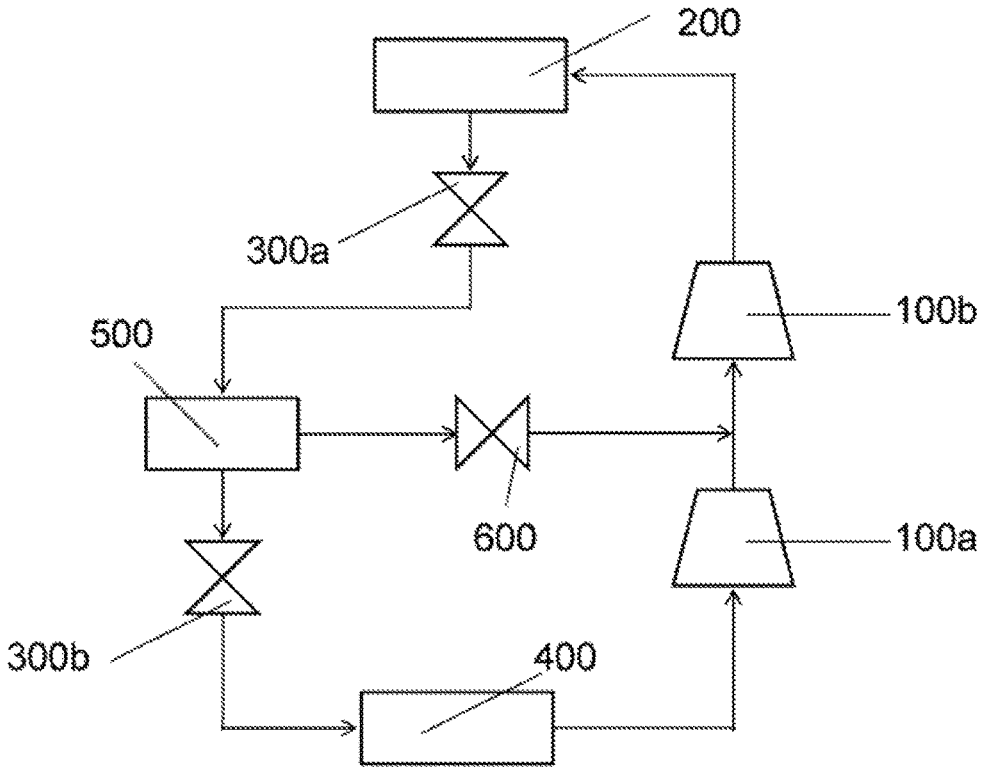
FIG. 1 is a schematic view of an embodiment of a heat pump system of the present invention.

Referring to FIG. 1, there is shown an embodiment of a heat pump system according to the concept of the present invention. The heat pump system comprises: a main heat exchange circuit and a gas supplement branch, wherein the main heat exchange circuit comprises a two-stage compressor 100*a*, 100*b*, a condenser 200, a throttle element and an evaporator 400, which are connected in sequence to form a circuit; and an economizer 500, disposed between the condenser 200 and the evaporator 400. The main heat exchange circuit mainly serves to provide a conventional refrigeration cycle or a heating cycle. In addition, a gas supplement branch which connects a gas outlet of the economizer 500 to a gas supplement port of the compressor 100*a*, 100*b* is further comprised, and an economizer regulating valve 600 for controlling the opening and closing of a flow path is arranged on the gas supplement branch. The gas supplement branch mainly serves to supplement a gaseous refrigerant for the intermediate stage of the compressor, in order to meet the requirements for realizing the two-stage compression. The heat pump system comprises a control device, wherein the control device can control the opening and closing of the economizer regulating valve 600 based on a refrigerant state feature in the evaporator 400 during the start-up stage of the heat pump system. Specifically, as an example, during start-up of the unit, when the refrigerant state feature in the evaporator 400 indicates that the saturated evaporation pressure thereof is too low, the control device will enable the economizer regulating valve to be opened, and the compressor obtains supplement gas from the gas supplement branch, thereby avoiding excessive pumping of refrigerant gas from the evaporator which causes the evaporation pressure thereof to be too low to start the unit. At this time, the evaporation pressure will return to normal so that the unit can be started successfully.

Here, the refrigerant state features applied in the foregoing embodiments include the saturated evaporation pressure of the refrigerant in the evaporator; and the heat pump system correspondingly comprises a refrigerant state feature sensor which can be used to measure parameters in the evaporator and in the economizer capable of reflecting the saturated evaporation pressure. During the implementation of this solution, there may be a variety of sensors that meet the above requirements. Several sensor examples will be listed below to assist in understanding the present concept.

As an example, the heat pump system correspondingly comprises a temperature sensor for measuring the refrigerant evaporation temperature in the evaporator 400. As another example, the heat pump system correspondingly comprises a pressure sensor for measuring the refrigerant evaporation pressure in the evaporator 400.

It is to be understood that, when the measure target is the refrigerant evaporation pressure, the corresponding saturated evaporation pressure value can be obtained directly from the refrigerant evaporation pressure. The acquisition process may be calculated according to an empirical formula or may query a corresponding characteristic parameter table. And when the measure target is the refrigerant evaporation temperature, the corresponding saturated evaporation temperature can be obtained first according to the refrigerant evaporation temperature, and then the corresponding saturated evaporation pressure is obtained according to the saturated evaporation temperature. The acquisition process may likewise be calculated according to an empirical formula or may query a corresponding characteristic parameter table.

Of course, according to the teachings of the foregoing principles and examples, those skilled in the art would also be able to conceive the use of other refrigerant state features for control.

Optionally, as a kind of specific examples, the throttle element may comprise a high pressure side float valve 300*a* disposed between the condenser 200 and the economizer 500 and/or a low pressure side float valve 300*b* disposed between the evaporator 400 and the economizer 500 so as to implement a throttle effect on this system.

According to another aspect of the present invention, there is also provided a start-up control method for a heat pump system, which can be applied to both the heat pump in the foregoing embodiments and other heat pump systems having corresponding control requirements.

The method protects at least the following steps:

S100, during a first preset period after the compressor 100*a*, 100*b* is started, if the refrigerant state feature in the evaporator 400 is lower than a set threshold, the economizer regulating valve 600 is opened and then the refrigerant accumulated in the economizer 500 is pumped into the compressor 100*a*, 100*b*; and/or S200, during the first preset period after the compressor 100*a*, 100*b* is started, if the refrigerant state feature in the evaporator 400 is higher than the set threshold, the economizer regulating valve 600 is opened after the first preset period and then the refrigerant accumulated in the economizer 500 is pumped into the compressor 100*a*, 100*b*.

The first preset period is the normal lag time set for the system and can be set according to the general environmental conditions of places where the device is used. For example, in one example, the first preset period is 1-5 minutes.

In the range of this period, if the refrigerant state feature in the evaporator 400 is lower than the set threshold, it means that if the economizer regulating valve is still not opened, it is highly possible that the problem of too low evaporation pressure will occur, thus affecting the operation of the system. At this time, step S100 should be performed, in which the economizer regulating valve 600 is started, and the refrigerant accumulated in the economizer 500 is pumped into the compressor 100*a*, 100*b*, thereby reducing the amount of refrigerant pumped into the compressor from the evaporator.

If the refrigerant state feature in the evaporator 400 is higher than the set threshold during the entire operation in the range of this period, it means that it can be operated according to the normal steps. At this time, step S200 should be performed to start the economizer regulating valve 600 after the first preset period and then the refrigerant accumulated in the economizer 500 is pumped into the compressor 100*a*, 100*b*.

In detail, when the refrigerant state features include the saturated evaporation pressure of the refrigerant in the evaporator, the start-up control method may be detailed as follows: S100, during the first preset period after the compressor is started, if the saturated evaporation pressure of the refrigerant in the evaporator is lower than a pressure threshold, the economizer regulating valve is opened and then the refrigerant accumulated in the economizer is pumped into the compressor; and/or S200, during the first preset period after the compressor is started, if the saturated evaporation pressure of the refrigerant in the evaporator is higher than the pressure threshold, the economizer regulating valve is opened after the first preset period and then the refrigerant accumulated in the economizer is pumped into the compressor.

In the range of this period, if the saturated evaporation pressure of the refrigerant in the evaporator is lower than the pressure threshold, it means that if the economizer regulating valve is still not opened, it is highly possible that the problem of too low evaporation pressure will occur, thus affecting the operation of the system. At this time, step S100 should be performed, in which the economizer regulating valve 600 is started, and the refrigerant accumulated in the economizer 500 is pumped into the compressor 100*a*, 100*b*, thereby reducing the amount of refrigerant pumped into the compressor from the evaporator.

If the saturated evaporation pressure of the refrigerant in the evaporator is higher than the pressure threshold during the entire operation in the range of this period, it means that it can be operated according to the normal steps. At this time, step S200 should be performed to start the economizer regulating valve 600 after the first preset period and then the refrigerant accumulated in the economizer 500 is pumped into the compressor 100*a*, 100*b*.

According to the start-up control method in the foregoing embodiments, if it is necessary to use the saturated evaporation pressure of the refrigerant in the evaporator as a judgment parameter, it is necessary to first obtain the parameter in the evaporator capable of reflecting the saturated evaporation pressure. An example of several parameters is also provided here.

For example, the parameter in the evaporator capable of reflecting the saturated evaporation pressure comprises a refrigerant evaporation pressure and/or a refrigerant evaporation temperature. Wherein, when the parameter in the evaporator capable of reflecting the saturation evaporation pressure comprises the refrigerant evaporation temperature, the saturated evaporation temperature is obtained based on the refrigerant evaporation temperature, and the saturated evaporation pressure is obtained based on the characteristic relation between the saturated evaporation temperature and the saturated evaporation pressure.

Furthermore, the pressure threshold for use as one of the criteria of judgment should also be set according to the general environmental conditions of places where the device is used. For example, in one example, the temperature threshold corresponding to the pressure threshold is below 40° F.

Optionally, a further embodiment is also provided in order to avoid the influence on the judgment result due to an unexpected condition, such as an instantaneous failure due to interference with the sensor. Wherein, during the first preset period after the compressor is started, if the refrigerant state feature in the evaporator is lower than the set threshold and this situation continues for a second preset period, the economizer regulating valve is opened and then the refrigerant accumulated in the economizer is pumped into the compressor. At this time, since the abnormality judgment state continues for the second preset period, the possibility of misjudgment is substantially excluded. This measure can further ensure the accuracy of the judgment results.

In addition, a set of software simulation schematic diagrams of start-up process performance curves corresponding to a heat pump system using the start-up control method and a heat pump system in the prior art are provided here.

Figure 2:
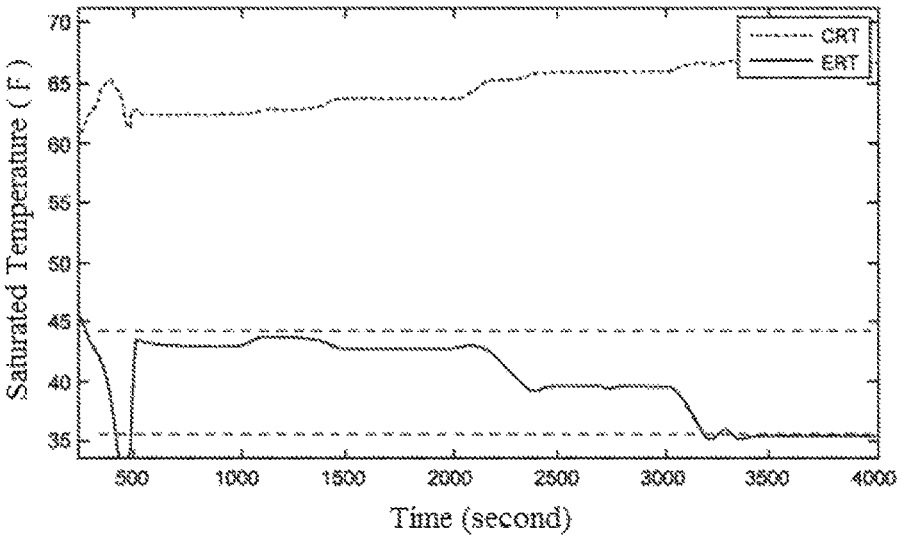
FIG. 2 is a software simulation schematic diagram of the temperature change of an evaporator and a condenser of a heat pump system in the prior art during a start-up control process.
Figure 3:
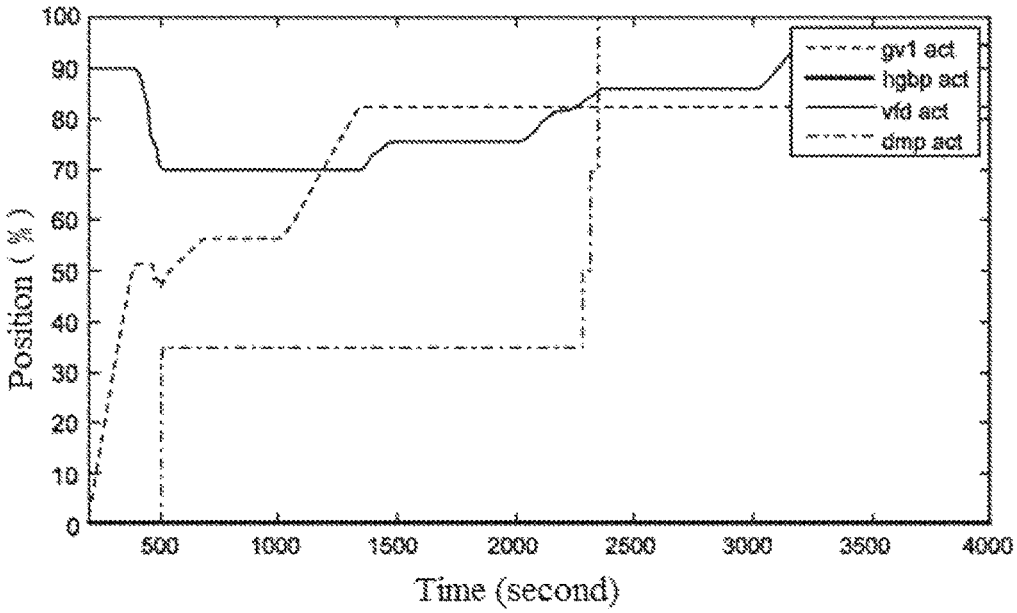
FIG. 3 is a software simulation schematic diagram of state changes of components of the heat pump system in the prior art during the start-up control process.

FIGS. 2 and 3 show the software simulation results of the heat pump system in the prior art. Referring to FIG. 2, the curve indicated by the solid line is the evaporator refrigerant temperature (ERT), and the curve indicated by the dotted line is the condenser refrigerant temperature (CRT). As can be seen from the figure, the evaporator refrigerant temperature drops abruptly in about 300 seconds after the unit is started, which is because the economic regulating valve fails to open after a long time, causing the accumulated refrigerant liquid in the evaporator to be continuously pumped into the compressor. The abrupt temperature drop stage continues until the economizer regulating valve is opened in 500 seconds after the unit is started.

Referring again to FIG. 3, the curve indicated by the thin solid line is the opening position of a frequency converter (vfd), which is used to indicate the degree of control of the operating frequency of the compressor; the curve indicated by the dotted line is the opening position of an inlet gas guide vane (gvl), which is used to indicate the degree of control of the inlet gas opening of the compressor; the curve indicated by the dot dash line is the opening position of the economizer regulating valve (dmp), which is used to indicate the degree of control of the opening of the gas supplement branch; and the curve indicated by the thick solid line is the opening position of a hot gas bypass valve (hgbp), which is used to indicate the degree of control of a hot gas bypass branch. In this example, the economizer regulating valve is set to open in 500 seconds after the unit is started. At this time, it can be seen that the inlet gas guide vanes cannot move to the normal opening degree. If it is in the actual application, the unit will issue an alarm or even stop. However, in the software simulation, since the safety logic is not set, the inlet gas guide vanes move slowly to the set opening degree when the economizer regulating valve is started in 500 seconds.

Figure 4:
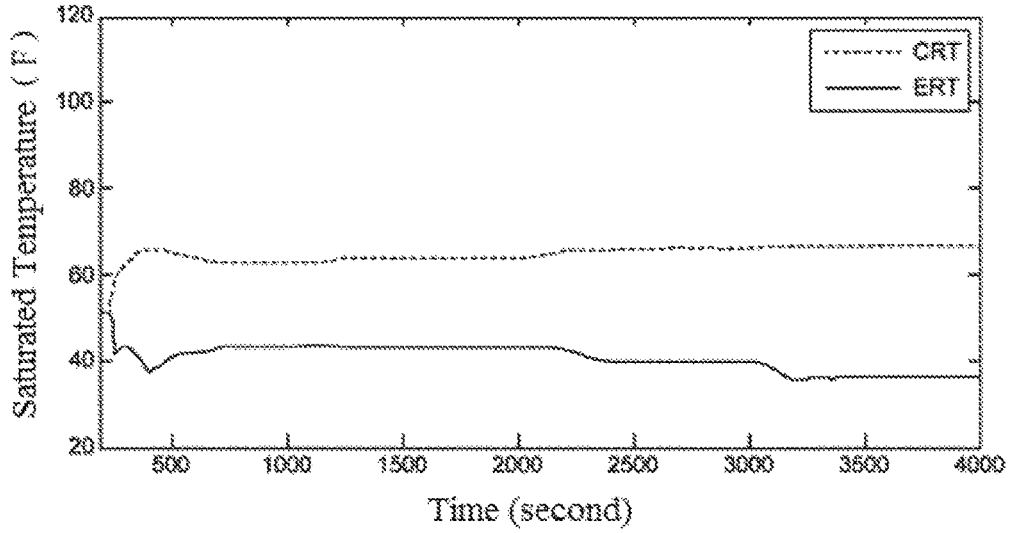
FIG. 4 is a software simulation schematic diagram of temperature changes of an evaporator and a condenser of a heat pump system in one embodiment of the present invention during a start-up control process.
Figure 5:
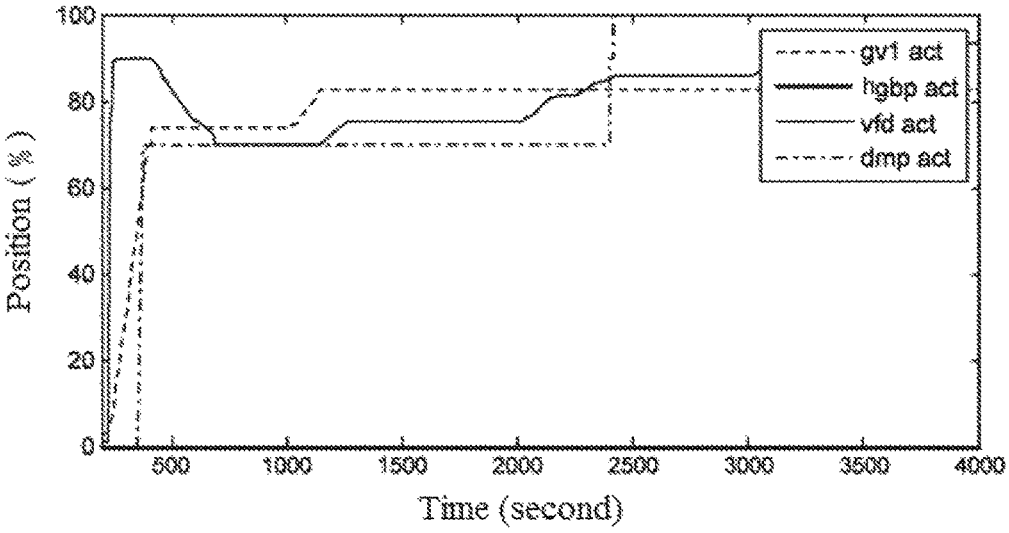
FIG. 5 is a software simulation schematic diagram of state changes of components of a heat pump system in one embodiment of the present invention during the start-up control process.

Correspondingly, FIGS. 4 and 5 show the software simulation results of the heat pump system in one embodiment of the present invention. Referring to FIG. 4, the curve indicated by the solid line is the evaporator refrigerant temperature, and the curve indicated by the dotted line is the condenser refrigerant temperature. As can be seen from the figure, the evaporator refrigerant temperature drops abruptly in about 300 seconds after the unit is started. At this time, the control device detects that the corresponding saturated evaporation pressure is lower than the set pressure threshold, and enables the economizer regulating valve to be opened in advance, and then the abrupt temperature drop amplitude and trend are immediately held back and gradually return to the normal start-up condition.

Referring again to FIG. 5, the curve indicated by the thin line is the opening degree of the frequency inverter, the curve indicated by the dotted line is the opening degree of the inlet gas guide vane, the curve indicated by the dot dash line is the opening degree of the economizer regulating valve, and the curve indicated by the thick solid line is the opening degree of the hot gas bypass valve. In this example, when the inlet guide vanes cannot continue to open for about 300 seconds after the unit is started, the economizer valve is opened. Then the inlet guide vanes continue to open, so that the entire start-up process of the unit can be carried out normally.

The above examples mainly explain the heat pump system of the present invention and the start-up control method therefor. Although only some of the embodiments of the present invention has been described, it is to be understood by those of ordinary skill in the art that the invention may be embodied in many other forms without departing from the spirit and scope thereof. Accordingly, the illustrated examples and embodiments are to be considered as illustrative but not restrictive, and the invention may cover various modifications and replacements without departing from the spirit and scope of the invention as defined by the appended claims.

What is claimed is:

1. A heat pump system, characterized by comprising:

a main heat exchange circuit, comprising a two-stage compressor, a condenser, a throttle element and an evaporator, which are connected in sequence to form a circuit;

an economizer, disposed between the condenser and the evaporator;

a gas supplement branch, connecting a gas outlet of the economizer to a gas supplement port of the compressor, with an economizer regulating valve for controlling the opening and closing of a flow path being arranged on the gas supplement branch; and a control device, wherein the control device controls the opening and closing of the economizer regulating valve based on a refrigerant state feature in the evaporator during a start-up stage of the heat pump system;

the refrigerant state feature comprises the saturated evaporation pressure of the refrigerant in the evaporator; the heat pump system further comprises a refrigerant state feature sensor for measuring a parameter in the evaporator capable of reflecting the saturated evaporation pressure of the refrigerant.

2. The heat pump system according to claim 1, wherein the throttle element comprises a high pressure side float valve disposed between the condenser and the economizer and/or a low pressure side float valve disposed between the evaporator and the economizer.

3. The heat pump system according to claim 1, wherein the heat pump system further comprises a temperature sensor for measuring the evaporation temperature of the refrigerant in the evaporator.

4. The heat pump system according to claim 1, wherein the heat pump system further comprises a pressure sensor for measuring the evaporation pressure of the refrigerant in the evaporator.

5. A heat pump system comprising:

a main heat exchange circuit, comprising a two-stage compressor, a condenser, a throttle element and an evaporator, which are connected in sequence to form a circuit;

an economizer, disposed between the condenser and the evaporator;

a gas supplement branch, connecting a gas outlet of the economizer to a gas supplement port of the compressor, with an economizer regulating valve for controlling the opening and closing of a flow path being arranged on the gas supplement branch; and a control device, wherein the control device controls the opening and closing of the economizer regulating valve based on a refrigerant state feature in the evaporator during a start-up stage of the heat pump system;

wherein the control device is configured to perform operations comprising:

S-100, during a first preset period after the compressor is started, if the refrigerant state feature in the evaporator is lower than a set threshold, the economizer regulating valve is opened and then the refrigerant accumulated in the economizer is pumped into the compressor; and/or S200, during the first preset period after the compressor is started, if the refrigerant state feature in the evaporator is higher than the set threshold, the economizer regulating valve is opened after the first preset period and then the refrigerant accumulated in the economizer is pumped into the compressor.

6. The heat pump system according to claim 5, wherein the refrigerant state feature comprises the saturated evaporation pressure of the refrigerant in the evaporator, wherein the control device is configured to perform operations comprising:

S100, during the first preset period after the compressor is started, if the saturated evaporation pressure of the refrigerant in the evaporator is lower than a pressure threshold, the economizer regulating valve is opened and then the refrigerant accumulated in the economizer is pumped into the compressor; and/or S200, during the first preset period after the compressor is started, if the saturated evaporation pressure of the refrigerant in the evaporator is higher than the pressure threshold, the economizer regulating valve is opened after the first preset period and then the refrigerant accumulated in the economizer is pumped into the compressor.

7. The heat pump system according to claim 6, wherein the saturated evaporation pressure in the evaporator is obtained based on the parameter in the evaporator capable of reflecting the saturated evaporation pressure.

8. The heat pump system according to claim 7, wherein the parameter in the evaporator capable of reflecting the saturated evaporation pressure comprises the refrigerant evaporation pressure and/or the refrigerant evaporation temperature.

9. The heat pump system according to claim 8, wherein when the parameter in the evaporator capable of reflecting the saturation evaporation pressure comprises the refrigerant evaporation temperature, the saturated evaporation temperature is obtained based on the refrigerant evaporation temperature, and the saturated evaporation pressure is obtained based on the characteristic relation between the saturated evaporation temperature and the saturated evaporation pressure.

10. The heat pump system according to claim 5, wherein the first preset period is 1-5 minutes.

11. The heat pump system according to claim 5, wherein the temperature threshold corresponding to the pressure threshold is below 40° F.

12. The heat pump system according to claim 5, wherein S-100 further comprises:

during the first preset period after the compressor is started, if the refrigerant state feature in the evaporator is lower than the set threshold and this situation continues for a second preset period, the economizer regulating valve is opened and then the refrigerant accumulated in the economizer is pumped into the compressor.

* * * * *